US007430823B1

(12) United States Patent
Chung

(10) Patent No.: US 7,430,823 B1
(45) Date of Patent: Oct. 7, 2008

(54) SNOW GLOBE

(75) Inventor: Hsi-Yao Chung, Kaohsiung Hsien (TW)

(73) Assignee: Gemmy Industries Corporation, Coppell, TX (US)

( * ) Notice: Subject to any disclaimer, the term of this patent is extended or adjusted under 35 U.S.C. 154(b) by 0 days.

(21) Appl. No.: 11/987,443

(22) Filed: Nov. 30, 2007

(51) Int. Cl.
*A63H 5/00* (2006.01)
*A63H 19/14* (2006.01)

(52) U.S. Cl. ..... 40/409; 40/410; 428/14

(58) Field of Classification Search ..... 40/409, 40/410; 428/14
See application file for complete search history.

(56) References Cited

U.S. PATENT DOCUMENTS 3,624,939 A * 12/1971 Gossard ..... 40/721
4,889,748 A * 12/1989 Dudley ..... 428/11
5,254,026 A * 10/1993 Kaiser ..... 446/220
D375,411 S * 11/1996 Hawkins ..... D6/314
5,713,147 A * 2/1998 Johnson ..... 40/771
5,853,824 A * 12/1998 Liu ..... 428/11
6,027,774 A * 2/2000 Fine et al. ..... 428/14
6,399,167 B1 * 6/2002 Lewis, Jr. ..... 428/11
6,438,878 B1 * 8/2002 Fine et al. ..... 40/409
6,562,423 B2 * 5/2003 Rubin ..... 428/13

* cited by examiner

*Primary Examiner*—Gary C Hoge
(74) *Attorney, Agent, or Firm*—Bacon & Thomas, PLLC

(57) ABSTRACT

A snow globe comprises a holder and a photo frame. The holder comprises a globe, a stand and a base. The globe is transparent and comprises a slot, a frame mount and decoration comprising particles. The frame mount is mounted in the globe and the slot is formed through an outer surface of the globe. The photo frame is mounted slidably in the globe, on the frame mount and has a openable backing and a window. Therefore, the snow globe provides visual entertainment while being personalized to increase sentiments of gifts or souvenirs.

20 Claims, 5 Drawing Sheets

SNOW GLOBE

BACKGROUND OF THE INVENTION

1. Field of the Invention

The present invention relates to a snow globe, especially to a snow globe having a removable photo frame.

2. Description of the Related Art

A snow globe is common decoration, often used and displayed in winter and given away as presents during winter holidays.

A conventional snow globe has a base and a transparent globe. The globe is mounted on the base. The globe is sealed with liquid and decoration. The decoration may include glitter, fake snow, colored balls or other such particles. When shaking the conventional snow globe, the glitter floats in the liquid in the globe of the snow globe. The conventional snow globe is normally a decoration or souvenir for Christmas.

In order to develop other usage except decoration, manufacturers desire adding functions to a conventional snow globe.

SUMMARY OF THE INVENTION

The main objective of the present invention is to provide a snow globe having a photo frame with replaceable photo.

To achieve the forgoing objective, a snow globe in accordance with the present invention comprises a holder and a photo frame. The holder comprises a globe, a stand and a base. The globe is transparent and comprises a slot, a frame mount and decoration comprising lightweight particles. The frame mount is mounted in the globe and the slot is formed through an outer surface of the globe. The photo frame is mounted slidably in the globe, on the frame mount and has an openable backing and a window. Therefore, the snow globe provides visual entertainment while being personalized to increase sentiments of gifts or souvenirs.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
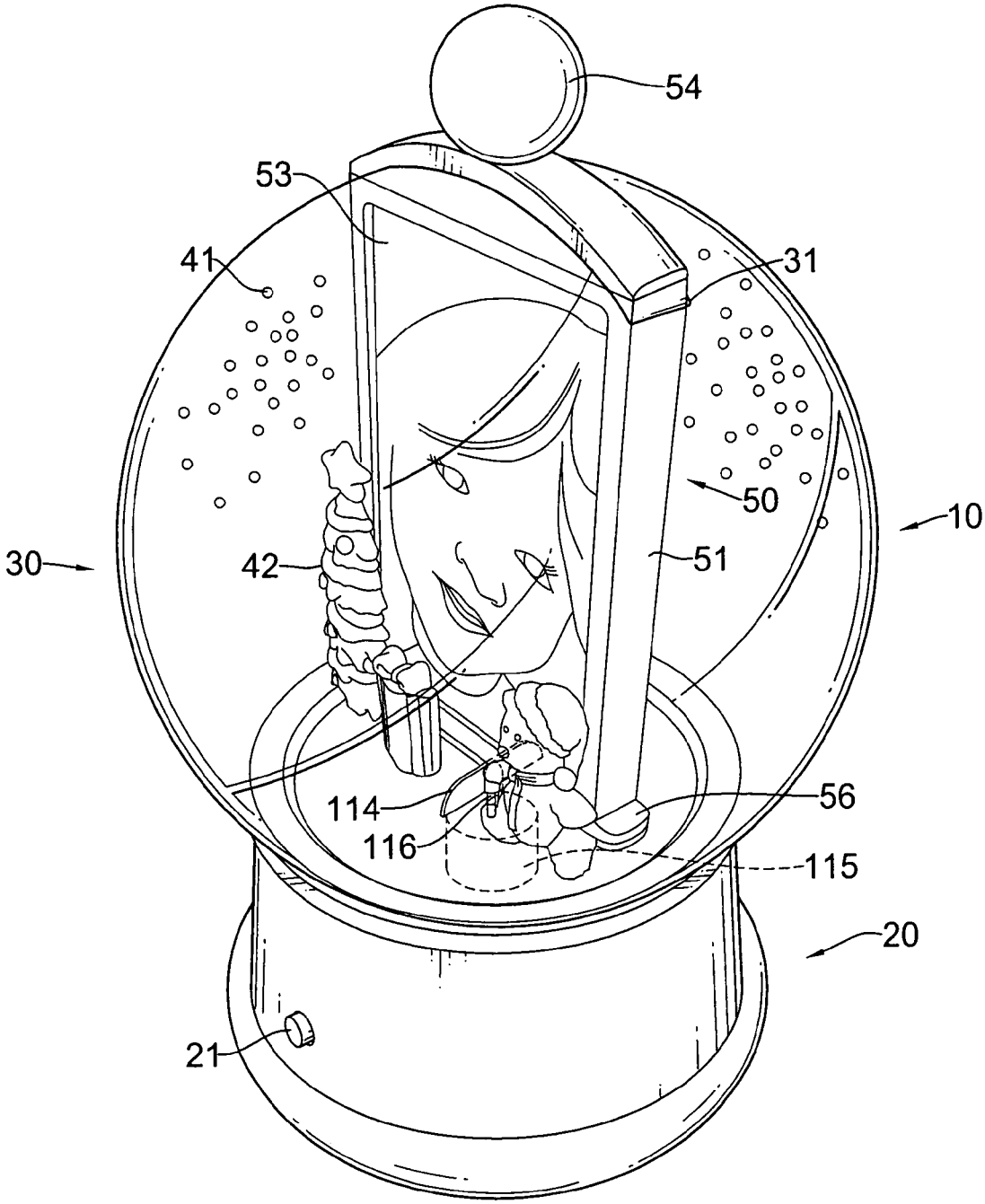
FIG. 1 is a perspective front view of a snow globe in accordance with the present invention.
Figure 2:
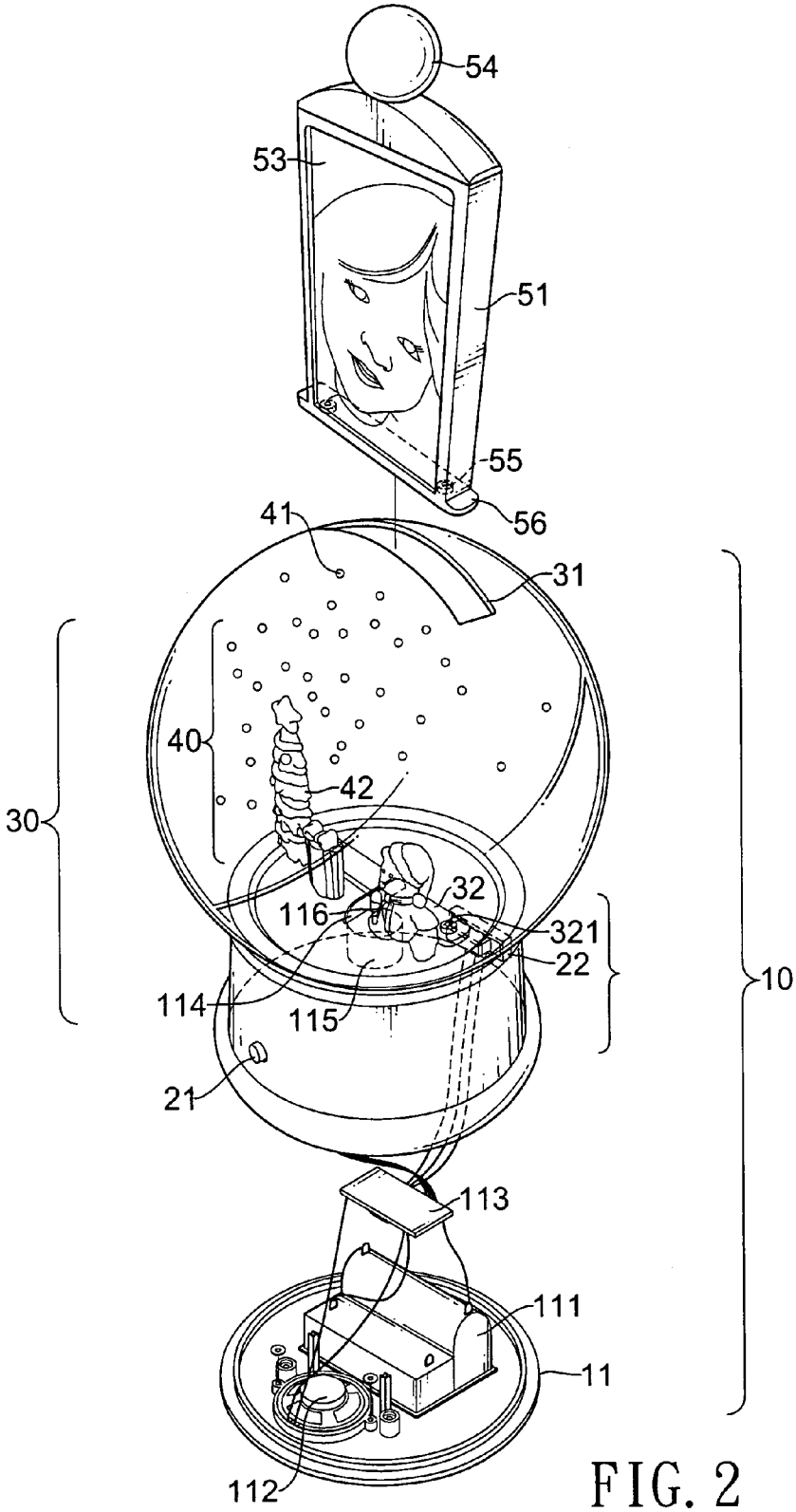
FIG. 2 is a partially exploded perspective view of the snow globe in FIG. 1.

With reference to FIGS. 1 and 2, a snow globe in accordance with the present invention comprises a holder (10) and a photo frame (50).

The holder (10) comprises a globe (30), a stand (20) and a base (11).

The globe (30) is transparent and has a bottom, a top, an outer surface, an inner surface, a slot (31), a frame mount (32), and decoration (40).

The slot (31) is formed through the outer surface at the top of the globe (30).

The frame mount (32) is mounted on the inner surface, at the bottom of the globe (30) and has a mounting surface and at least one optional connector (321). Each connector (321) is formed on the mounting surface of the frame mount (32).

The decoration (40) comprises multiple floatable particles (41) and at least one optional figurine (42). The particles (41) may be plastic foam such as expanded polystyrene or the like. Each figurine (42) is mounted adjacent to the frame mount (32) and represents a corresponding scene and may be an autumnal tree, decorated Christmas tree, present, Santa Claus, teddy bear or other like statuette.

The stand (20) is mounted on the globe (30) and comprises an optional activation switch (21) and an optional selector switch (22). The switches (21, 22) are mounted moveably on the stand (20).

The base (11) is mounted under the stand (20) and optionally comprises a printed circuit board (PCB) (113), a power supply, a speaker (112) and a fan (114).

The PCB (113) may be mounted on the base (11) and electronically connected to the switches (21, 22). The power supply may be connected to the PCB (113) and may be a battery pack (111). The speaker (112) may be connected electronically to the PCB (113) and connected electrically to the power supply (111). The fan (114) may be connected electronically to the PCB and electrically to the power supply (111) and comprises an optional motor (115) and at least one optional blade (116). The motor (115) may be connected electrically to the power supply (111) and electronically to the PCB (113), may be mounted adjacent to the globe (30), may be on the base and has a drive shaft (116). The drive shaft (116) is formed on and protrudes from the motor (115) and has a distal end that may be mounted through the globe (30). Each blade (116) is mounted on the distal end of the drive shaft. The selector switch (22) is used to control the setting and may be moved to a permanent on position, fan on position, fan and music on position, activation on position, off position or the like. The permanent on position turns the fan (114) and music on. The fan on position turns the fan (114) on. The activation position supplies power to the speaker (112) and fan (114) but requires actuation by the activating switch (21) to drive the fan (114) and speaker (112) for a predetermined period of time. The off position disables the fan (114) and speaker (112) for storage.

When on, the fan (114) is driven by the motor (115) causing air to be circulated thereby, lifting and dispersing the particles (41) around the globe (30) for pleasing aesthetic looks with optional musical accompaniment.

Figure 3:
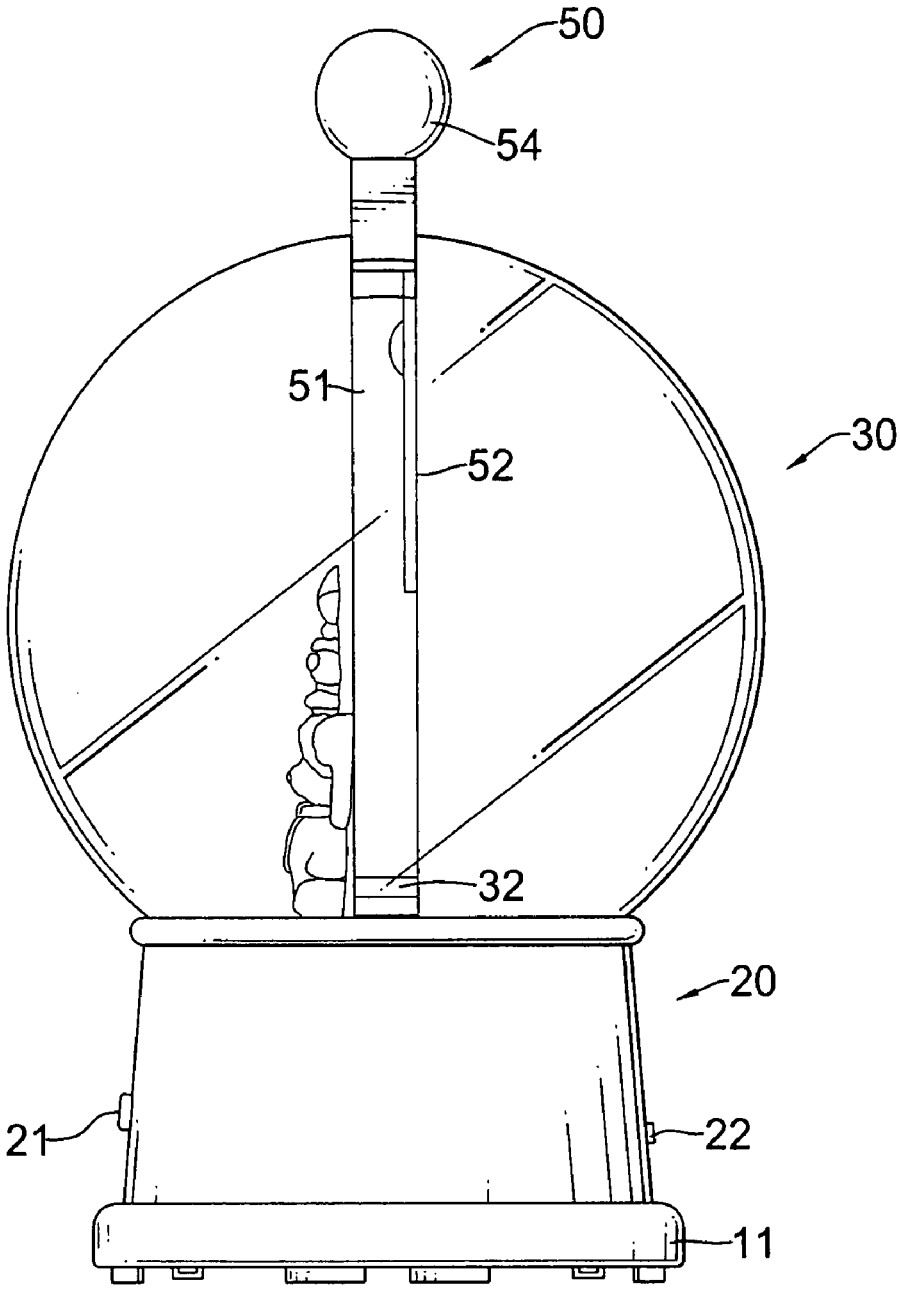
FIGS. 3 to 5 are operational side views of the snow globe in FIG. 1 shown with a photo frame being pulled out and a photo being replaced by detaching the backing.
Figure 4:
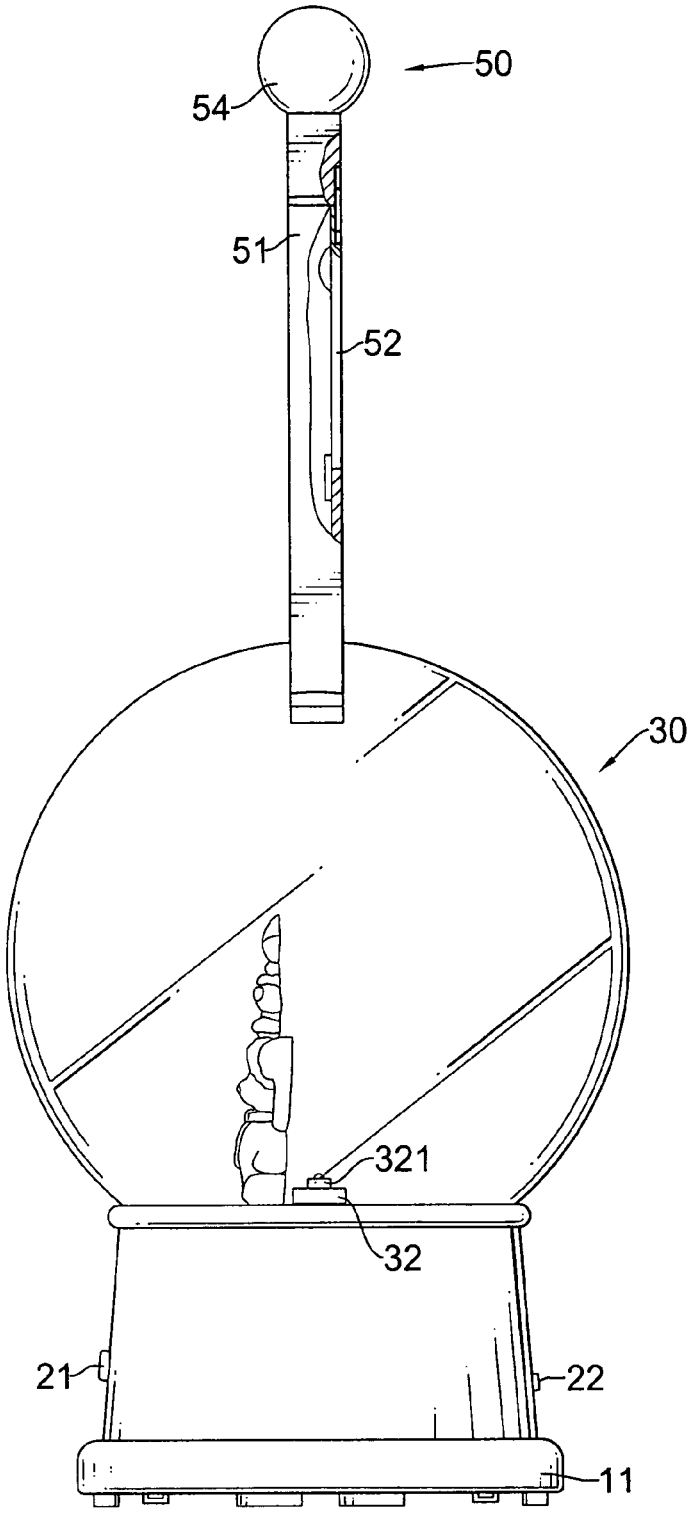
Figure 5:
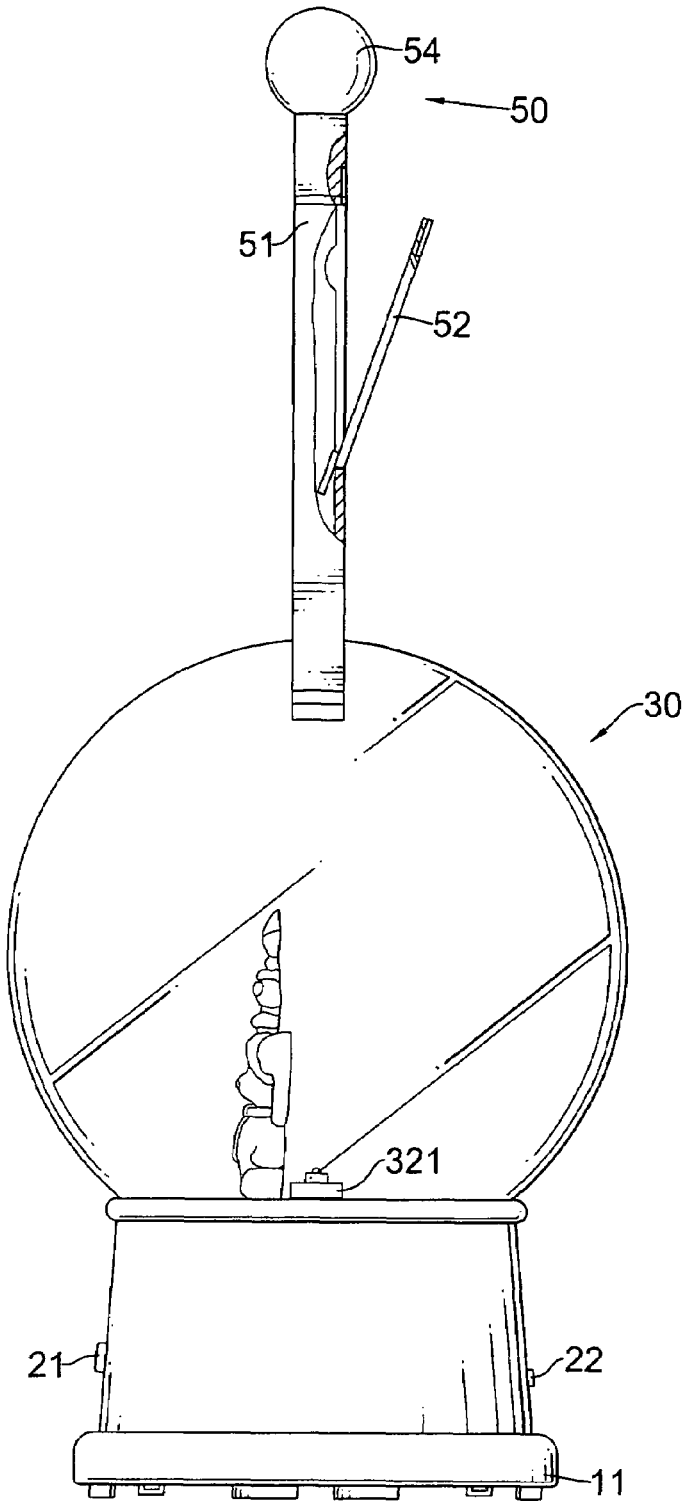

With further reference to FIGS. 3 to 5, the photo frame (50) is mounted slidably in the globe (30). The photo frame (50) is mounted on the frame mount (32) and has a molding (51), a window (53), an openable backing (52), two optional feet (56), at least one optional connector (55) and an optional ornamental knob (54).

The molding (51) has a rear, a front, a top and a bottom surface. The window (53) is mounted securely in the molding (51). The openable backing (52) is mounted slidably and detachably on the rear of the molding (51) to hold a photo against the window (53). The feet (56) are formed on and protrude paralelly from the bottom surface of the molding (51). The ornamental knob (54) is attached to the top of the molding to allow a person to slide the photo frame (30) out easily. Each connector (55) is formed on the bottom surface of the molding (51) and corresponds to the connector (321) on the frame mount (32) to hold the photo frame (50) securely in the globe (30).

The photo in the photo frame (50) can be changed easily by lifting the photo frame (50) out of the globe (30), detaching the openable backing (52), changing the photo and replacing the photo frame (50) in the globe (30).

Therefore the snow globe has a personal feel and may be altered depending on season, while improving a sentiment of giving or holiday souvenir.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A snow globe, comprising:

a holder comprising a globe being transparent and having a bottom;

a top;

an outer surface;

an inner surface;

a slot being formed through the outer surface at the top of the globe;

a frame mount being mounted on the inner surface at the bottom of the globe and having a mounting surface; and a decoration comprising multiple floatable particles;

a stand being mounted on the globe; and a base being mounted under the stand a photo frame being mounted slidably in the globe and being mounted on the frame mount and having a molding having a front, a rear, a top and a bottom surface;

a window being mounted securely in the molding; and an openable backing being mounted on the rear of the molding.

2. The snow globe as claimed in claim 1, wherein the stand further comprises an activation switch mounted moveably on the stand; and a selector switch mounted moveably on the stand; and the base further comprises a printed circuit board (PCB) mounted on the base and electronically connected to the activation switch and the selector switch;

a power supply connected to the PCB;

a speaker connected electronically to the PCB and electrically to the power supply; and a fan connected electronically to the PCB and electrically to the power supply and comprising a motor mounted adjacent to the globe and having a drive shaft having a distal end formed on and protruding from the motor; and at least one blade mounted on the distal end of the drive shaft of the motor.

3. The snow globe as claimed in claim 1, wherein the frame mount comprises at least one connector formed on the mounting surface of the frame mount and the photo frame has at least one connector formed on the bottom surface of the molding to correspond to the connector on the frame mount.

4. The snow globe as claimed in claim 2, wherein the frame mount comprises at least one connector formed on the mounting surface of the frame mount and the photo frame has at least one connector formed on the bottom surface of the molding to correspond to the connector on the frame mount.

5. The snow globe as claimed in claim 1, wherein the decoration further comprises at least one figurine being mounted adjacent to the frame mount.

6. The snow globe as claimed in claim 4, wherein the decoration further comprises at least one figurine being mounted adjacent to the frame mount.

7. The snow globe as claimed in claim 2, wherein the distal end of the drive shaft of the motor is mounted through the globe.

8. The snow globe as claimed in claim 6, wherein the distal end of the drive shaft of the motor is mounted through the globe.

9. The snow globe as claimed in claim 1, wherein the photo frame has two feet formed on and protruding parallelly from the bottom surface of the molding.

10. The snow globe as claimed in claim 8, wherein the photo frame has two feet formed on and protruding parallelly from the bottom surface of the molding.

11. The snow globe as claimed in claim 1, wherein the photo frame has an ornamental knob attached to the top of the molding frame.

12. The snow globe as claimed in claim 10, wherein the photo frame has an ornamental knob attached to the top of the molding frame.

13. The snow globe as claimed in claim 1, wherein the openable backing is mounted slidably and detachably on the rear of the molding.

14. The snow globe as claimed in claim 12, wherein the openable backing is mounted slidably and detachably on the rear of the molding.

15. The snow globe as claimed in claim 1, wherein the particles are plastic foam.

16. The snow globe as claimed in claim 14, wherein the particles are plastic foam.

17. The snow globe as claimed in claim 1, wherein the particles are exploded polystyrene.

18. The snow globe as claimed in claim 14, wherein the particles are exploded polystyrene.

19. The snow globe as claimed in claim 2, wherein the power supply is a battery pack.

20. The snow globe as claimed in claim 14, wherein the power supply is a battery pack.

* * * * *